US007260917B2

(12) United States Patent
Brookbank et al.

(10) Patent No.: US 7,260,917 B2
(45) Date of Patent: Aug. 28, 2007

(54) BALANCE CONTROL SYSTEM FOR A MOVABLE BARRIER OPERATOR

(75) Inventors: Thomas A. Brookbank, Chicago, IL (US); James J. Fitzgibbon, Batavia, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/967,469

(22) Filed: Oct. 18, 2004

(65) Prior Publication Data

US 2005/0081452 A1 Apr. 21, 2005

Related U.S. Application Data

(62) Division of application No. 10/119,817, filed on Apr. 10, 2002, now Pat. No. 7,017,302.

(51) Int. Cl.
*E06B 3/00* (2006.01)

(52) U.S. Cl. ..... 49/506; 49/197

(58) Field of Classification Search ..... 49/197, 49/199, 360, 506; 318/266, 434, 466, 468
See application file for complete search history.

(56) References Cited

U.S. PATENT DOCUMENTS 5,929,580 A 7/1999 Mullet et al.
6,118,243 A 9/2000 Reed et al.
6,161,438 A 12/2000 Mullet et al.
6,326,751 B1 12/2001 Mullet et al.
6,605,910 B2 * 8/2003 Mullet et al. ..... 318/264
6,696,806 B2 * 2/2004 Study et al. ..... 318/280
2001/0024095 A1 9/2001 Fitzgibbon et al.

* cited by examiner

*Primary Examiner*—Jerry Redman
(74) *Attorney, Agent, or Firm*—Fitch, Even, Tabin & Flannery

(57) ABSTRACT

A balance control system comprises a motor, a transmission system providing connection between the motor and the door and adapted to move the door between a closed position and an open position located above the closed position, a counterbalance system to reduce power required to lift the door, an apparatus to generate first signal representing a force used to move the door from the closed position to the open position, and to generate a second signal representing a force used to move the door from the open position to the closed position, and a controller responsive to the first signal and to the second signal to indicate an imbalance of the door when a difference between the first signal and the second signal exceeds a predetermined threshold.

13 Claims, 6 Drawing Sheets

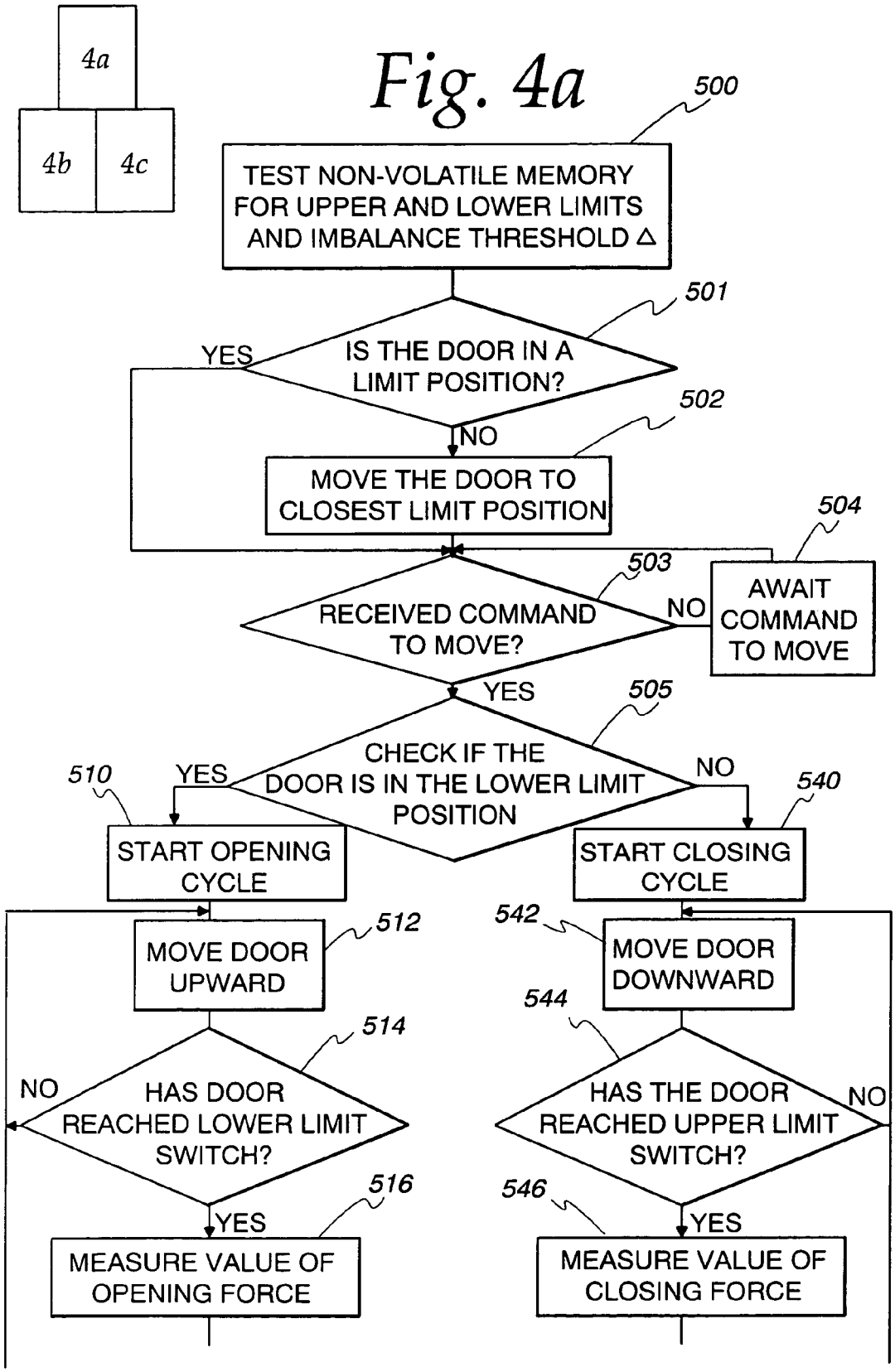
4a
4b
4c
Fig. 4a
500
TEST NON-VOLATILE MEMORY FOR UPPER AND LOWER LIMITS AND IMBALANCE THRESHOLD Δ
501
IS THE DOOR IN A LIMIT POSITION?
YES
NO
502
MOVE THE DOOR TO CLOSEST LIMIT POSITION
504
AWAIT COMMAND TO MOVE
503
RECEIVED COMMAND TO MOVE?
NO
YES
505
CHECK IF THE DOOR IS IN THE LOWER LIMIT POSITION
YES
NO
510
540
START OPENING CYCLE
START CLOSING CYCLE
512
MOVE DOOR UPWARD
542
MOVE DOOR DOWNWARD
544
514
HAS DOOR REACHED LOWER LIMIT SWITCH?
NO
YES
HAS THE DOOR REACHED UPPER LIMIT SWITCH?
NO
YES
516
546
MEASURE VALUE OF OPENING FORCE
MEASURE VALUE OF CLOSING FORCE

BALANCE CONTROL SYSTEM FOR A MOVABLE BARRIER OPERATOR

CROSS-REFERENCE TO RELATED APPLICATION

This application is a division of prior application Ser. No. 10/119,817, filed Apr. 10, 2002 now U.S. Pat. No. 7,017,302, which is hereby incorporated herein by reference in its entirety.

BACKGROUND OF THE INVENTION

The invention relates to a balance system, in particular to a balance state indicator for a movable barrier operator.

Most known movable barrier operators, or garage door operators include a motor having a transmission connected to it, which is coupled to a barrier for opening and closing the barrier. With a vertically moved barrier, there are normally preset upper and lower limits of travel. The upper and lower limits are employed to create a safe operational travel range.

Balance springs are often attached to a vertically moving barrier to offset the weight of the door. This is an aid to human barrier movers as well as the motor of automatic barrier movers. Other types of door balancing arrangements are known but infrequently used. Balance springs may be torsion springs, which mounted above the barrier opening on a shaft which rotates. The balancing force of the torsion springs is generally conveyed to the barrier by flexible members such as cables, which take up or pay out on drums attached to rotate with the torsion spring shaft. In other arrangements, the balance springs may be expansion springs, which are stretched when the barrier is lowered and contract when the barrier is raised. The expansion springs are commonly attached above barrier guide tracks and connect to the barrier by flexible members running over pulleys.

In the case of garage door systems the amount of spring tension to balance the door is determined by the amount of balance spring tension to hold the barrier at about three to four feet above the floor. That is, a properly balanced garage door would stay in the half open position. If the door closes by itself, the springs require more tension. If the door opens by itself, the door springs have too much tension. As the garage door system ages, or part of the balance system breaks, the balance may deviate. The door balance may deviate to a point at which it is extremely difficult or dangerous to continue to operate the door. However, due to the robustness of door operators, the out of balance condition may go unnoticed by human operators who merely push control button to open and close the door. Thus, there is a need for a balance system that would be able to determine when the garage door system passes its imbalance threshold and notify the owner that the garage door is out of balance.

SUMMARY OF THE INVENTION

The present invention is directed to a method and system for balance measurement of a movable barrier operator. The method includes determining a first movement parameter representing an opening force applied to the movable barrier for a travel between a lower limit position and an upper limit position, and determining a second movement parameter representing a closing force applied to the movable barrier for a travel between the upper limit position and the lower limit position; comparing said first movement parameter with said second movement parameter; and, when the difference between said first movement parameter and said second movement parameter exceeds a predetermined threshold, indicating that the movable barrier operator is out of balance.

The opening force may be a maximum force or an average force measured during the complete movement of the barrier between a closed position and an open position, and the closing force may be a maximum force or an average force measured during the complete movement between the open position and the closed position. Also, the opening/closing force may be a force measured at a predetermined point during the movement between the lower limit position and the upper limit position during an opening/closing cycle. The determining step of the method may include calculating representations of the opening force value and the closing force value from the first and second movement parameters, respectively, and comparing the opening force value with the closing force value to determine balance condition.

A balance control system of the present invention comprises a motor, a transmission system providing connection between the motor and the door and adapted to move a door between a closed position and an open position located above the closed position; a counterbalance system to reduce power required to lift the door; an apparatus to generate first signal representing a force used to move the door from the closed position to the open position, and to generate a second signal representing a force used to move the door from the open position to the closed position; and a controller responsive to the first signal and to the second signal to indicate an imbalance of the door when a difference between the first signal and the second signal exceeds a predetermined threshold.

The value of the opening force may be an average, or maximum, value of the first signal generated during the movement of the door between the closed position and the open position, and the value of the closing force is an average, or maximum, value of the second signal generated during the movement of the door between the open position and the closed position. The system may comprise switches to initiate first signal representing the opening force when the garage door starts moving upward from the closed position, and to initiate the second signal representing the closing force when the garage door starts moving downward ward from the open position. The counterbalance system for this balance control may include a torsion spring assembly. The garage door operator may be a trolley-mounted operator or a jack shaft operator. When the door is out of balance, the controller may generate a correcting signal, or initiating an imbalance indicator, which may in response provide a visual, audible, or any other kind of signal.

The apparatus may comprise a tachometer for measuring an opening speed and a closing speed of the motor when the garage door moves between the open and closed positions, and the first and second signals may be proportional to the respective motor speeds.

Also, the apparatus may comprise speed detectors for measuring the first, or opening speed, and the second, or closing speed of the door movement between open and closed positions, so that to generate the first and second signals proportional to these respective speeds.

The apparatus may comprise a tension detector for measuring an opening tension and a closing tension of the torsion spring during the door movement, and the first signal and second signal may be proportional to the respective torsion spring tensions.

A method for balance control of a garage door operator comprises steps of generating a first signal having a value proportional to an opening force used for movement of the garage door from a closed position to an open position; generating a second signal having a value proportional to a closing force used for movement of the garage door between the open position and the closed position; comparing values of the first signal and the second signal to detect a difference between the opening force and the closing force; and, when said difference exceeds a predetermined threshold, indicating that the door is out of balance.

An upper limit and a lower limit for a garage door movement may be preset, and the first and second generated signals may be proportional respectively to the opening force and to the closing force applied to the garage door. The opening and closing forces are calculated from the opening speed and the closing speed of the motor detected during the movement of the door between the lower and upper limits.

In another embodiments the opening force is an average value/maximum value of a force used to move the garage door during the movement between the closed position and the open position, and the closing force is an average value/maximum value of a force used to move the garage door during the movement between the open position and the closed position.

The opening and closing forces also may be functions of the opening speed and the closing speed of the garage door measured when the door passes a predetermined point during movement between the lower limit and the upper limit.

The opening and closing speeds may also be measured in a plurality of predetermined points during the door movement between the lower and upper limits, and a calculated average value of the closing speed is then compared with an average value of the opening speed.

DESCRIPTION OF THE PREFERRED EMBODIMENTS

Figure 1:
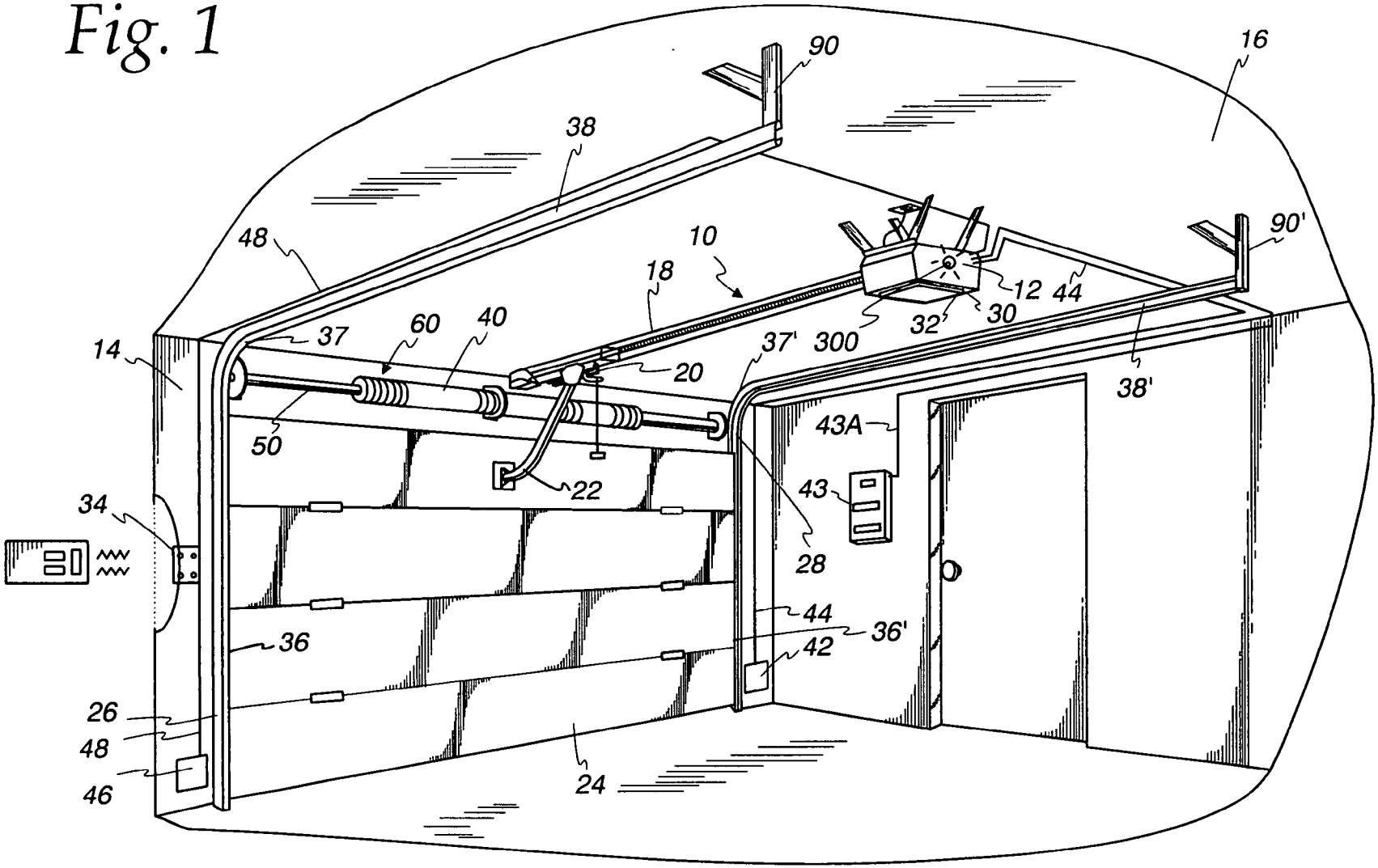
FIG. 1 is a perspective view of a garage having a garage door.

Referring now to the drawings and especially to FIG. 1, a movable barrier operator, or more specifically, a garage door operator is shown therein and referred to by numeral 10. The operator comprises a head unit 12 mounted to the ceiling 16 of the garage. The head unit includes an electric motor 30 coupled to a transmission, which includes a rail 18 extending from the head unit 12 and a movably attached trolley 20 with an arm 22 extending to a multiple paneled garage door 24. The motor moves the garage door 24, opening and closing it by pulling or pushing the trolley 20. The door is carried upward and downward in a pair of L-shaped rails 26 and 28 by rollers (not shown), which ride in the rails and movably support the garage door upon curved guide rails. The L-shaped rails 26 and 28 shown in FIG. 1 are suspended by hangers 90, 90' from the ceiling 16 of the garage. The rails include vertical straight portions 36, 36', curved portions 37, 37' and substantially straight horizontal portions 38, 38'. In order to reduce the force required of the motor 30 to lift the door 24, the garage door is provided with a counterbalance system 60. The counterbalance system 60 includes a helical torsion spring 40 mounted on a drive shaft 50, which horizontally extends across the wall 14 above the upper edge of the garage door. In the closed position of the door 24 as shown in FIG. 1, the spring 40 is wound to the maximum extent providing a lifting force to counter-balance the weight of the door and reducing the motor power to be applied to the door in order to open it. In the open position of the door the spring 40 is partially unwound reducing the counter-balancing force provided.

Figure 2:
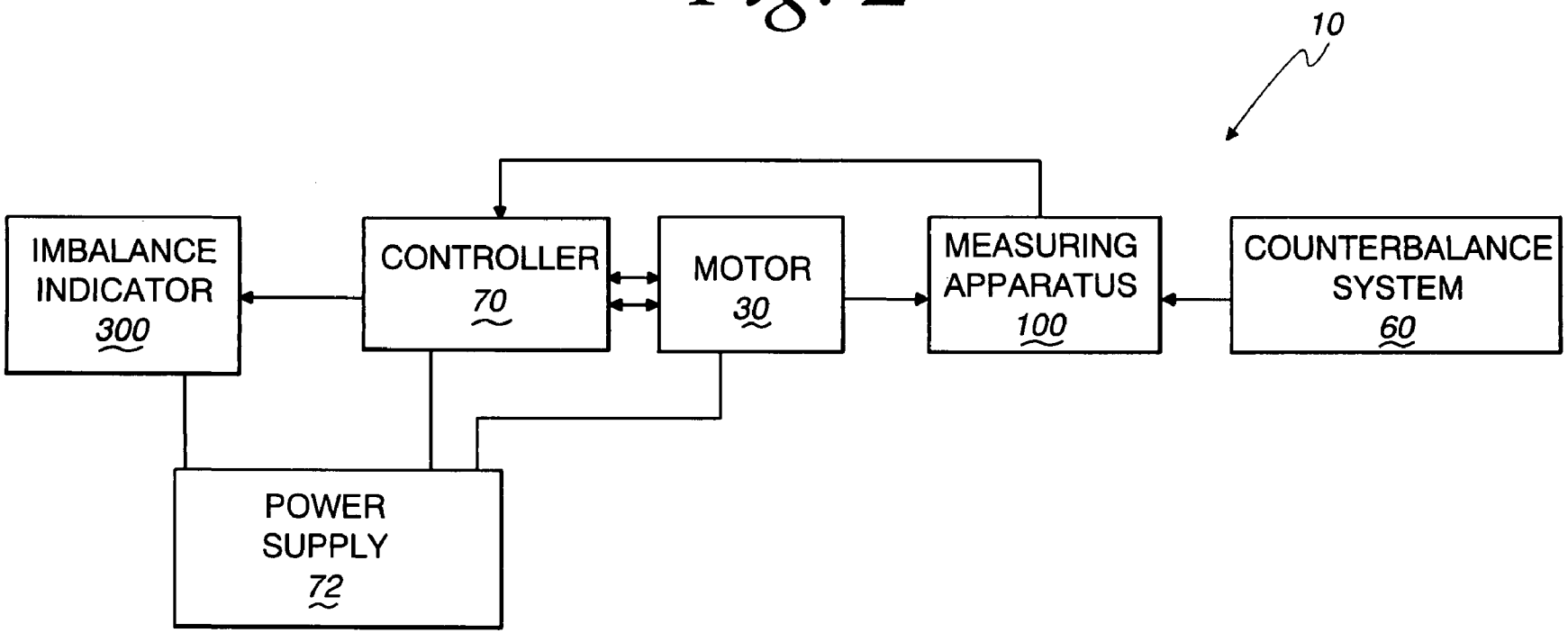
FIG. 2 is a block diagram of the garage door operator having a balance system of the present invention.

As shown in FIG. 2, the garage door operator 10 has a reversible electric motor 30, the balance system 60, a controller 70, a power supply unit 72, a measuring apparatus 100 and an imbalance indicator 300. The electric motor 30 is connected to the power supply unit 72 to be energized thereby when the controller 70, also energized by the power supply unit 72, enables the electric motor 30 to turn in order to open or close the garage door 24 by pulling or pushing the trolley 20. The measuring apparatus provides measurement of the force applied to the garage door during an opening/closing cycle either directly, or by measuring parameters such as the motor speed, the moving speed of the door or the tension of the torsion spring 40 of the counterbalance system 60. The apparatus 100 generates a signal representing the opening/closing force and sends it to the controller 70. In the controller the signal is compared to a signal representing closing/opening force which was stored in the controller memory during the previous cycle, and if the difference between the forces exceeds the preset threshold, the controller initiates the imbalance indicator 300, also energized from the power supply unit 72.

Figure 3:
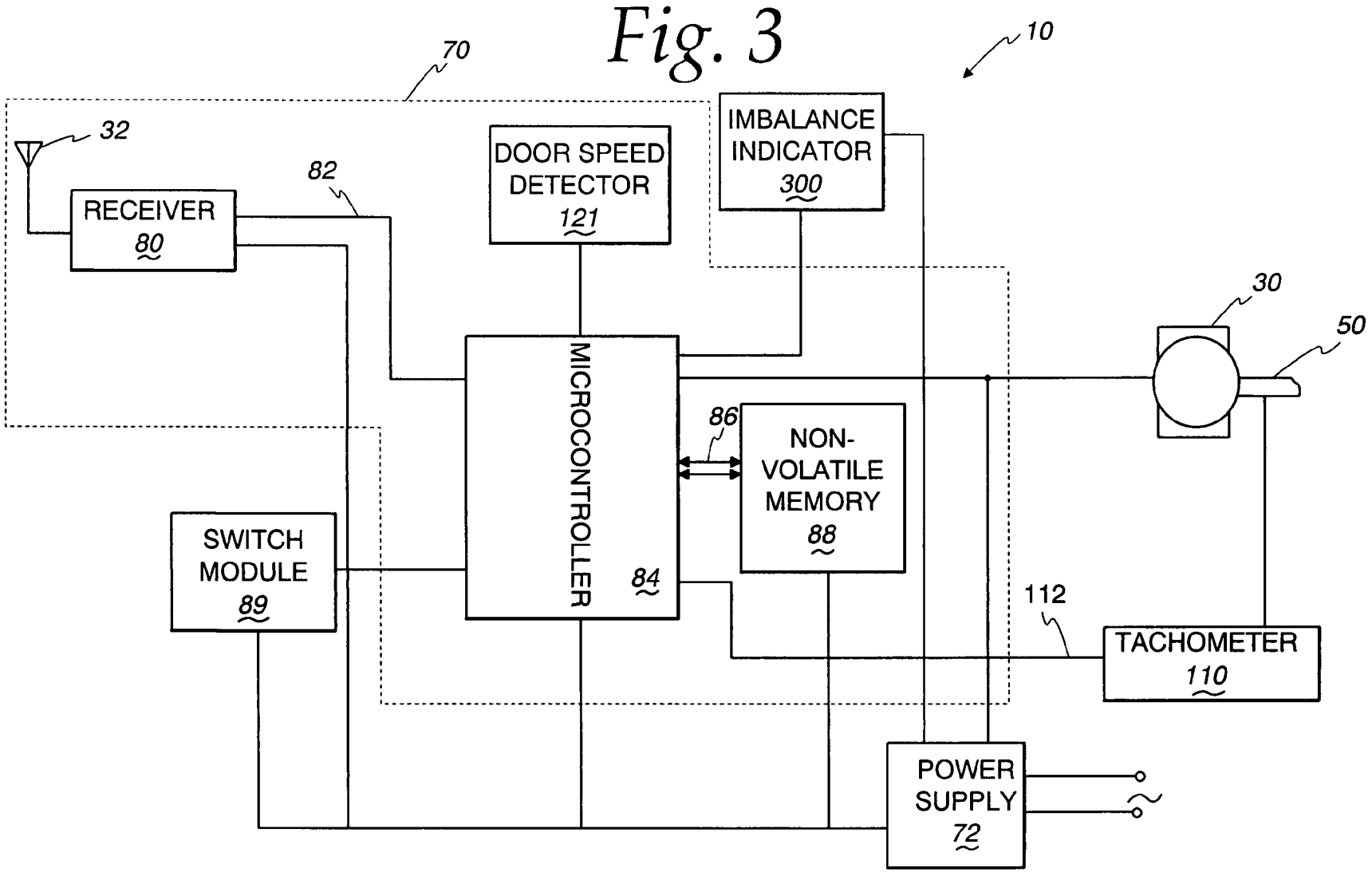
FIG. 3 is an block diagram of the controller employed by the garage door operator of the present invention.

FIG. 3 shows a schematic diagram of the controller 70, which comprises a RF receiver 80 having an antenna 32 to receive command signals from a handheld transmitter and coupled via a line 82 to a microcontroller 84 to supply demodulated digital signals from a transmitter. The receiver is energized by a power supply unit 72. The microcontroller is also coupled by a bus 86 to a non-volatile memory 88, which non-volatile memory stores set points and other customized digital data related to the operator, including in the present embodiment the upper and lower door movement limits as well as a balance threshold data. The microcontroller 84 may have its mode of operation controlled by a switch module 39 mounted outside the head unit 12 and coupled to the microcontroller 84. The microcontroller 84 in response to switch commands sends signals to the reversible electric motor 30 having a drive shaft 50 coupled to the transmission of the garage door operator. A tachometer 110 is coupled to the drive shaft 50 and provides a tachometer signal on a tachometer line 112. The tachometer signal, which is being indicative of the speed of rotation of the motor 30, is provided to the microcontroller 84, which stores the maximum value of motor speed during the cycle. For example, the maximum motor speed value is measured during a door opening cycle. The measured value is transferred by calculation into the value of a maximum force applied to the garage door during the opening cycle, and compared with the maximum force value measured during the previous closing cycle, which has been stored in a volatile memory within the microcontroller 84. The difference between the maximum force applied to the garage door during the current opening cycle and the maximum force applied to the door during the previous closing cycle is then compared with the threshold value stored in the non-volatile memory 88. When the difference exceeds the threshold value, the imbalance indicator 300 is energized to show that the door is out of balance. The indicator may be a light emitting diode, or an audio alarm device, or some other indicator device. The microcontroller 84 may also generate digital signals in case of the door imbalance, for example, to indicate the balance problem on a computer screen. Also, the controller may generate a command precluding the door from further opening before the imbalance problem is solved. The maximum force value previously stored in the microcontroller 84 is then overwritten with the maximum force value of the current opening cycle. The maximum force applied to the door during the next closing cycle will be compared to the maximum force of the present opening cycle stored in the microcontroller.

The controller 70 may also include a door speed detector 121 to read the value of the door movement speed at a predetermined point during the opening or closing cycle and to register a maximum speed value for the cycle. The signal representing the maximum value of the door speed is then forwarded to the microcontroller 84, and a maximum value of the force applied to the door during the cycle is calculated. This maximum force value is stored in the volatile memory to be compared with the maximum force value of the next cycle.

In another embodiment, the maximum speed of rotation of the motor is forwarded to the microcontroller and compared to the maximum speed value stored in the microcontroller during the previous cycle, and a force difference is calculated from this speed difference and compared to a preset balance threshold.

In yet another embodiment an average speed of the motor is calculated during the cycle, and the average speed is compared with an average speed stored in the microcontroller during the previous cycle, the difference is then compared with a preset balance threshold.

In another embodiment, the speed of the door is measured in a predetermined position, and compared with the speed of the door during the previous cycle. The speed may also be measured in several points of the door movement between the lower and upper limits, and an average speed be calculated and compared with an average speed stored during the previous cycle.

Figure 4B:
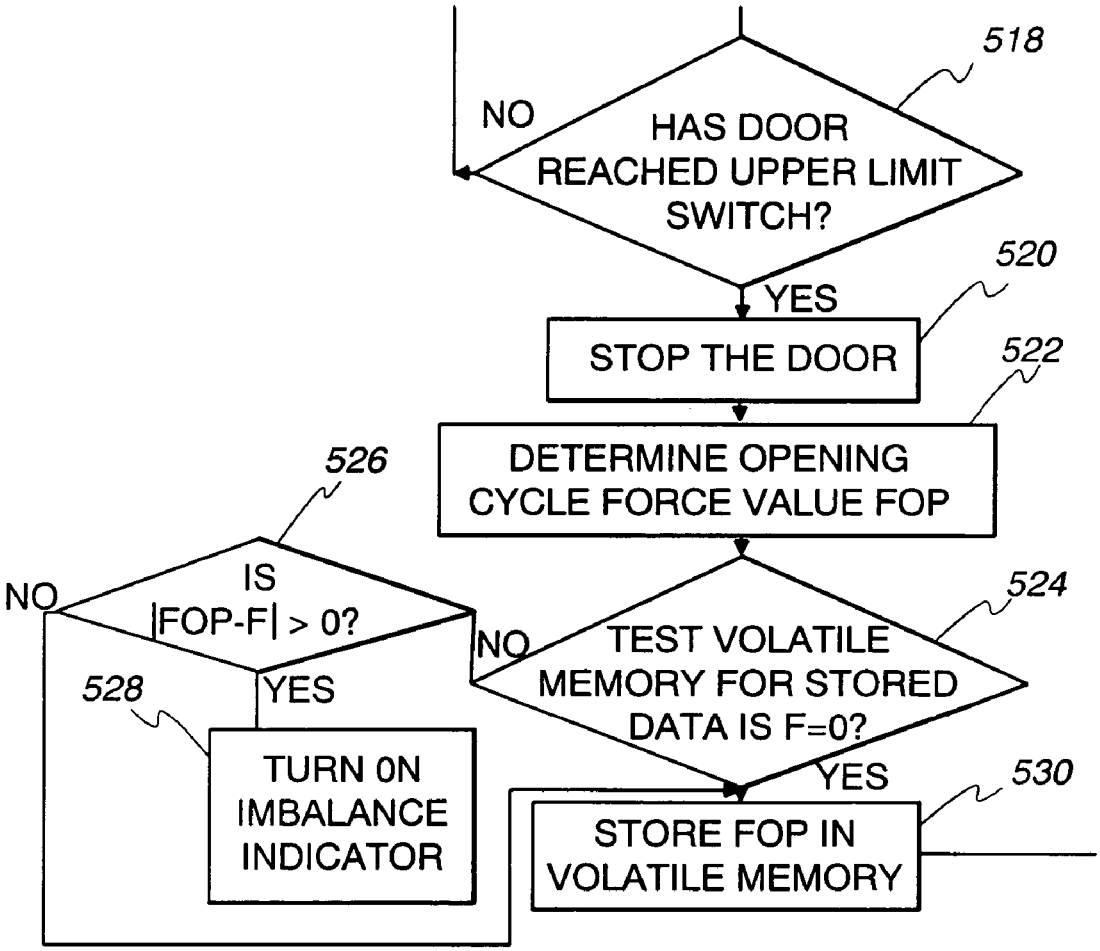
FIG. 4 is a flow diagram of the balance determination routine of the balance system of the present invention.
Figure 4C:
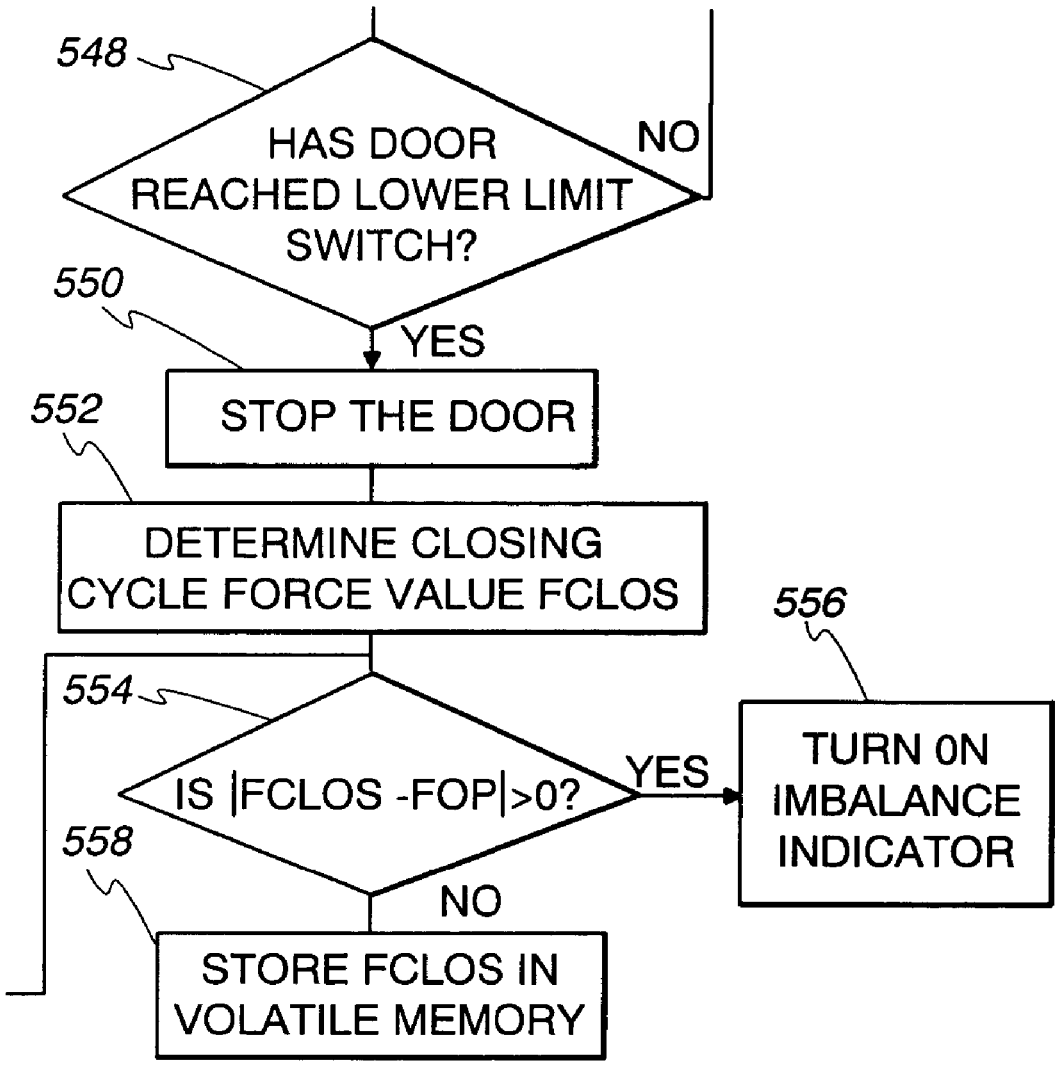

The preferred embodiment of the balance system operates under the base routine shown in FIG. 4.

When the controller 70 is energized, in step 500, a test is run for the state of the non-volatile memory, checking stored values of the upper and lower limits of the door movement, and the value of the imbalance threshold Δ. Then in step 501 the last state of the operator is tested, that is whether the operator indicated the door position as being at its upper limit, down limit or in the middle of its travel. If the door is not in a limit position, in step 502 it is moved to the closest limit position. In the following step 503 the controller awaits the receipt of a command to move the door. When the command is detected, control is transferred to step 505 and the position of the door is determined. If the door is in the lower limit position, flow proceeds to step 510 and the opening cycle begins. Alternatively, if the door is in the upper limit position, the closing cycle begins with the step 540.

In step 510 the controller sends an opening command to the motor, and in step 512, motor is energized and the door starts moving upward. In step 514 a test is run whether the door has reached the lower limit switch. If not, the control is transferred back to step 512 and the door is moved farther up. If the door has reached the lower limit point, the control is transferred to step 516, and the measurement of the value of the opening force applied to the door is begun. In step 518 a test is run whether the door reached it's upper limit switch. If the test is negative, the control is transferred back to step 512 and the door is moved farther up. When it is determined that the door reached it's upper limit switch, in step 520 the door is stopped. In step 522 the opening cycle force is determined. In the present embodiment the maximum value of the opening force applied to the door during the opening cycle is measured and stored. In step 524 the volatile memory is checked for door movement force data. If no such data is stored in the volatile memory, $F=0$, the value of the opening cycle force Fop determined in step 522 is stored in the volatile memory. If the volatile memory contains a value of closing cycle force stored during the previous closing cycle, $F\neq 0$, in step 526 the opening cycle force Fop is compared with the closing cycle force F stored in the volatile memory. The force difference $|Fop-F|$ is calculated and compared with the threshold value Δ stored in the non-volatile memory of the controller. If the difference exceeds the threshold value, $|Fop-F|>\Delta$, the imbalance indicator is turned on in step 528 to indicate that the door is out of balance. If the difference is $|Fop-F|<\Delta$, the control is transferred to step 530, wherein the opening cycle force value Fop is stored in the volatile memory.

If step 505 indicated that the door is not in the lower limit position but in the upper limit position, the step 540 begins a closing cycle. The controller sends a closing command to the motor, and in step 542 the door starts moving downward. In step 544 a test is run whether the door has reached the upper limit switch. If the test is negative, control is transferred back to step 542 to move the door farther down. If the door has reached the upper limit, the control is transferred to step 546, where the value of the closing force applied to the garage door is measured in order to determine the value of the closing cycle force. The closing cycle force represents a maximum value of the force applied to the door during the closing cycle. When the test provided in step 548 shows that the door reached the lower limit switch, the command to stop the door follows from the controller, which stops the door in step 550. In step 552, the closing cycle force value is determined. In step 554, the closing cycle force value is compared with the opening cycle force stored in the volatile memory during the previous opening cycle. If the difference between the values of the opening cycle force and the closing cycle force is greater than the threshold value stored in the non-volatile memory, $|Fop-Fclos|>\Delta$, the imbalance indicator is turned on to indicate that the door is out of balance (step 556). The control is transferred to step 558 to store the value Fclos in the volatile memory, overwriting the previously stored value. If the difference is lower than the threshold value, $|FopFclos|<\Delta$, the control is transferred from step 554 directly to step 558, and the value Fclos is stored in the volatile memory. In the above example a maximum force is used as a control parameter. However, an average value of the force may be used.

In another embodiment, the speed values of the door movement during the opening and the closing cycle are compared, and the differential force is calculated from the speed difference and then compared with the threshold value stored in the non-volatile memory. The opening and closing speed is measured when the door passes some predetermined position, or an average opening/closing cycle speed is calculated from the speed values measured in several predetermined positions during the opening/closing cycle.

In yet another embodiment, the signal representing the force value is the tachometer output signal showing the motor speed during the opening/closing cycle.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A method for balance measurement of a garage door operator, comprising:

determining an upward force measurement value representing an opening force required to move the garage door from a closed position to an open position;

determining a downward force measurement value representing a closing force required to move the garage door from an open position to a closed position;

comparing the upward force measurement value with the downward force measurement value; and indicating that the movable barrier operator is out of balance when a difference between the upward force measurement value and the downward force measurement value exceeds a predetermined threshold.

2. A method of claim 1, wherein the opening force is a maximum force measured during travel from the closed position to the open position, and the closing force is a maximum force measured during travel from the open position to the closed position.

3. A method of claim 1, wherein the opening force is an average force measured during travel from the closed position to the open position, and the closing force is an average force measured during travel between the open position and the closed position.

4. A method of claim 1, wherein the opening force is a force measured at a predetermined point during travel from the closed position to the open position, and the closing force is a force measured at said predetermined point during travel from the open position to the closed position.

5. A method of claim 1, wherein the indicating step comprises providing a visual indication of an out of balance condition.

6. A method of claim 1, wherein the indicating step comprises providing an audible indication of an out of balance condition.

7. A method for balance control of a garage door and a garage door operator, comprising steps of:

generating a first signal having a value proportional to an opening force used to move the garage door from a closed position to an open position;

generating a second signal having a value proportional to a closing force used to move the garage door from said open position to said closed position;

comparing values of said first signal and said second signal to detect a difference between said opening force and said closing force; and indicating that the door is out of balance when said difference exceeds a predetermined threshold.

8. The method of claim 7, further comprising a step of setting an upper limit and a lower limit for a door movement.

9. The method of claim 8, wherein the steps of generating signals proportional to the opening force and the closing force comprise detecting a maximum opening/closing speed of a motor during the movement of the door between said lower limit and said upper limit, and calculating the opening/closing force value from the respective speed value.

10. The method of claim 8, wherein the opening force is a function of an opening speed measured at a predetermined point during the movement of the door from the lower limit to the upper limit, and the closing force is a function of a closing speed measured at said predetermined point during movement of the door from the upper limit to the lower limit.

11. The method of claim 8, wherein the steps of generating the first and second signals comprise measuring the opening speed at a plurality of predetermined points during the door movement from the lower limit to the upper limit, and measuring the closing speed at a plurality of predetermined points during the door movement from the upper limit to the lower limit, and wherein in said comparing step an average value of said closing speed is compared with an average value of said opening speed.

12. The method of claim 7, wherein the opening force is an average value of a force used during the movement from the closed position to the open position, and the closing force is an average value of a force used during the movement from the open position to the closed position.

13. The method of claim 7, wherein the opening force is a maximum force used during the movement from the closed position to the open position, and the closing force is a maximum force used during the movement from the open position to the closed position.

* * * * *

UNITED STATES PATENT AND TRADEMARK OFFICE

CERTIFICATE OF CORRECTION

PATENT NO. : 7,260,917 B2
APPLICATION NO. : 10/967469
DATED : August 28, 2007
INVENTOR(S) : Brookbank et al.

It is certified that error appears in the above-identified patent and that said Letters Patent is hereby corrected as shown below:

Column 7, Claim 1, Line 18: Change “movable barrier” to -- garage door --.

Signed and Sealed this
Seventeenth Day of July, 2012

David J. Kappos

David J. Kappos
*Director of the United States Patent and Trademark Office*